US008696345B2

(12) United States Patent
Sprick-Schütte et al.

(10) Patent No.: US 8,696,345 B2
(45) **Date of Patent: *Apr. 15, 2014**

(54) MEANS FOR PROVIDING PACKAGING MATERIAL

(75) Inventors: Stefan Sprick-Schütte, Bielefeld (DE); Oliver Schmidt, Meensen (DE)

(73) Assignee: Sprick GmbH Bielefelder Papier- und Wellpappenwerke & Co., Bielefeld (DE)

( * ) Notice: Subject to any disclaimer, the term of this patent is extended or adjusted under 35 U.S.C. 154(b) by 335 days.

This patent is subject to a terminal disclaimer.

(21) Appl. No.: 13/060,905

(22) PCT Filed: May 29, 2009

(86) PCT No.: PCT/EP2009/003876

§ 371 (c)(1), (2), (4) Date: Jul. 8, 2011

(87) PCT Pub. No.: WO2010/025784

PCT Pub. Date: Mar. 11, 2010

(65) Prior Publication Data

US 2012/0040040 A1 Feb. 16, 2012

(30) Foreign Application Priority Data

Aug. 25, 2008 (DE) ..... 10 2008 039 612

(51) Int. Cl.
*B31D 5/00* (2006.01)

(52) U.S. Cl.
USPC ..... 425/403.1; 493/352; 493/407; 493/464; 493/967

(58) Field of Classification Search
CPC ..... B31D 5/0047; B31D 2205/0082
USPC ..... 425/403.1; 493/352, 407, 464, 967
See application file for complete search history.

(56) References Cited

U.S. PATENT DOCUMENTS 7,186,208 B2 * 3/2007 Demers et al. ..... 493/350
2007/0287623 A1 * 12/2007 Carlson et al. ..... 493/464

* cited by examiner

*Primary Examiner* — Yogendra Gupta
*Assistant Examiner* — Alison Hindenlang
(74) *Attorney, Agent, or Firm* — R. Michael West

(57) ABSTRACT

Disclosed is an apparatus for providing packaging material, comprising a shaping device (25) that has a couple of motor-driven molding wheels or rolls, a housing support (15) with an interior, an inlet via which packaging material can be fed into the interior, and an outlet via which packaging material can be discharged from the interior in which the molding wheels are arranged. The molding wheels are rotatably mounted on the housing support and each define an axis of rotation. A continuous penetration shaft (23), the longitudinal direction of which extends substantially parallel to the two axes of rotation of the molding wheels, from the interior to the exterior of the housing support, is formed withing the housing support, said penetration shaft (23) being open towards the interior and towards an exterior of the housing support.

19 Claims, 9 Drawing Sheets

MEANS FOR PROVIDING PACKAGING MATERIAL

Figure 1:
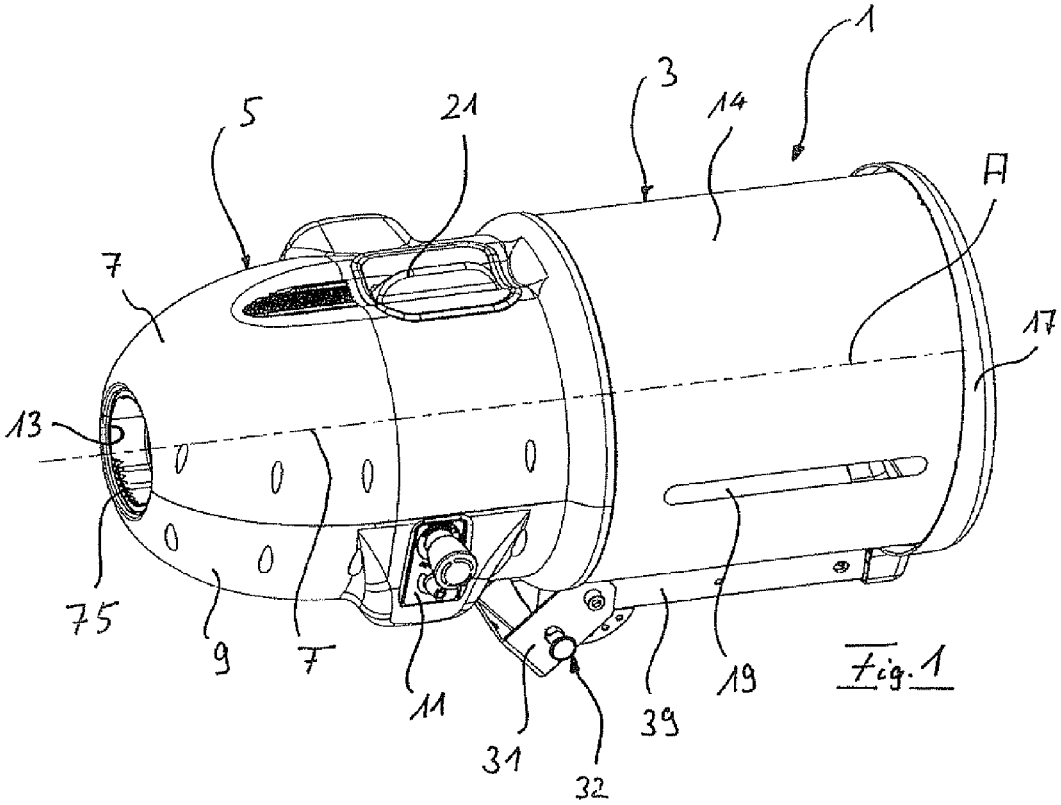

The invention relates to a means for providing packaging material comprising a moveable reshaping device presenting a pair of motor driven forming wheels or forming rollers, and a stationary housing support at which the reshaping device is held and mounted.

Such a means, in the following referred to as packaging means, is known from DE 10 2005 053 319 A1. This proven packaging means has a packaging material reservoir upstream of the housing support, in which reservoir a packaging reel, such as a paper reel, is inserted that is reeled off from the inside, which enables faster withdrawal of the paper web without larger force requirement for the reshaping device. The packaging material reservoir is connected to a housing support featuring a feeder funnel and a mounting structure in which a tunnel-shaped and/or canal-shaped internal space is provided for lodging the forming wheels the internal space is limited by a partially symmetrical and/or cone shaped internal wall structure of the housing support and defines an output opening as well as an input opening. Via the output opening reshaped packaging material can leave the internal space.

Each forming wheel is rotatably mounted, wherein a rotational axis is defined for each forming wheel, the rotational axes being parallel to each other. The forming wheels define a deformation zone where the packaging material is deformed through rolling engagement of the forming wheels and in particular is thereby driven for the transport through the housing support.

It is an object of the invention to improve the known means for providing packaging material such that a packaging material jam, having possibly occurred owing to a discontinuity in consistency of the packaging material, can easily be remedied.

This object is achieved by the features of claim 1.

Accordingly, an uninterrupted access passage is formed in the housing support, open towards the internal space and open towards an outside of the housing support, the longitudinal direction of the access passage being essentially parallel to the two rotational axes of the forming wheels and extending from the internal space to the outside of the housing support. The longitudinal direction can be defined by a straight middle axis of the access passage, wherein an uninterrupted delimiting wall of the access passage may well be inclined with respect to the middle axis. According to the invention, a clear width of the access passage at the outside opening shall coincide with a clear width of the inside opening such that manual access to both forming wheels is possible. Preferably the uninterrupted delimiting wall of the access passage extends straight and in parallel to its middle axis.

The outside of the housing support can also form the uncovered external surface of the housing of the packaging means, to which the access passage leads up.

The access passage has a maximum width that is smaller than the maximum diameter of one forming wheel of the reshaping device.

The internal space of the housing support is formed in a tunnel shape and has an input opening via which the packaging material is pulled into the internal space, and an output opening via which the reshaped packaging material is dispensed out of the internal space of the housing support. For delimiting the internal space the housing support has partially cylindrical and/or partially cone shaped wall sections forming a radially circumferential, closed wall structure that is closed with the exception of the input opening, the output opening and the lateral opening into which the access passage leads up from the outside of the packaging means.

Besides forming a mounting structure for the forming wheels, the housing support serves the purpose of carrying an outer housing or outer covers for protection and/or for creation of a design of the packaging means, wherein the access passage extends up to the free outside of the outer housing.

Thus, the access passage according to the invention extends from the outside of the packaging means to the tunnel-shaped internal wall structure delimiting the internal space of the housing support, wherein in particular the access passage over its essentially straight course is delimited by a tube-shaped wall that, at the outside, can in particular continuously merge into the outer face of the packaging means and, at the inside, can continuously merge into the tunnel-shaped internal wall structure.

According to the invention it is possible to act on both forming wheels by means of a simple manual access with one hand and to possibly remedy a packaging material jam in the area of the reshaping zone of the forming wheels. Tests by the applicant have shown that the most frequent cause of a packaging jam is located in the reshaping zone, where the largest operating forces within the packaging device are transmitted to the packaging material, such as a paper web reeled off the inside of a reel.

In a preferred embodiment the forming wheels define a deformation zone at their area of engagement disposed inside of the tunnel-shaped internal space of the housing support. In the deformation zone the forming wheels deform and in particular drive the packaging material, in order to transport it through the internal space of the housing support. Either the forming wheels are completely disposed inside the internal space of the housing support, in particular by means of a respective recess, or they extend partially out of the housing support via respective open slots having a complementary shape. In the latter case, besides the input opening, the output opening and possible slots, the housing support will have a lateral opening the access passage leads up to.

With the measure according to the invention of arranging the essentially straight access passage in parallel to the rotational axes of the forming wheels it is made easier for an operating person to remedy a possibly occurring packaging material jam simultaneously at both forming wheels. Additionally, the relative arrangement of the access passage to the forming wheels according to the invention enables direct access to the deformation zone, where the forming wheels in fact form and in particular drive the packaging material. It is to be understood that the reshaping device shall be the only driving means providing forward propulsion of the packaging material of the means according to the invention.

In a further development of the invention the forming wheels are disposed in a plain to which the longitudinal extension of the access passage is perpendicular.

In a further development of the invention the access passage is arranged with respect to the forming wheels such that for a visual projection of the smallest clear width of the access passage in its longitudinal direction onto a common plain of the two forming wheels, sections of the forming wheels facing each other, in particular upstream of the reshaping zone, are, in particular in equal proportions, inside of boundaries of the projection.

In a preferred embodiment of the invention the packaging means is in particular held at an essentially vertical support column pivotable around a horizontal pivoting axis. In this way the output opening of the packaging means can be held in different positions relative to a transport box, in particular at different inclinations with respect to the horizontal, in order to introduce the packaging material into the transport box in a targeted manner.

Preferably an in particular straight transport path is defined between the input opening and the output opening through the housing support. The transport path can be delimited mainly by an internal wall of the housing support continuously extending from the input opening to the output opening without the necessity of an additional moveable guiding device for the packaging material within the housing support. The transport path defines a straight transport axis through the housing support that is in particular concentrically or centrally surrounded by an internal wall. The access passage is disposed essentially at the axial position of the reshaping device within the axial course of the transport axis. In case of a horizontal positioning of the transport path by means of respective adjustment of the fixation of the packaging means at the support column, the forming wheels can be disposed in a common horizontal plain. Preferably the access passage is disposed above the common horizontal plain so that vertical access to the forming wheels from above through the access passage is enabled. In this way handling the packaging means during manual access to the forming wheels through the access passage can be ergonomically facilitated.

Preferably a distance between one forming wheel and the outside of the housing support measured through the access passage is essentially equal to a distance between the other forming wheel and the outside of the housing support through the access passage.

In a preferred embodiment of the invention the access passage is dimensioned such that manual access to both forming wheels by an operating person is possible through the access passage. Therein the maximum diameter of the access passage at the outside of the housing support, at the inside of the housing support and in longitudinal direction of the access passage can be 8 to 16 cm, preferably about 12 cm.

In a further development of the invention the access passage presents an opening towards the outside that is essentially rectangular, in particular with respect to its cross section. It shall be understood that the opening can also have other forms of cross section, such as a circular shape. In case of a rectangular cross section the corners are rounded in particular.

The access passage can also present an essentially rectangular opening, in particular with respect to its cross section, towards the internal space, wherein also different forms of cross section, such as a circular shape, can be considered. It is to be understood that the corners of a rectangular cross section are rounded in particular.

Preferably the shape of the cross section of the access passage does not change along the access passage.

In a further development of the invention the delimiting edge of the opening towards the outside is aligned with the delimiting edge of the opening towards the inside of the access passage.

Preferably the clear width of the access passage is constant and unchanged in its longitudinal direction.

The access passage can be delimited by an internal wall that corresponds to an internal wall of a uniform tube profile with an essentially constant internal circumference along the access passage.

In a preferred development of the invention the access passage is closed by a bung, the inside of which, facing the internal wall, forms a continuation in shape of the adjacent internal wall sections for creating a continuous, in particular, essentially uninterrupted internal wall structure of the internal space of the housing support. If, for example, the opening of the access passage facing the internal space extends into the area of a feeder funnel of the housing support with a cone-shaped internal wall, it is to be understood that the inner side of the bung is adapted to the cone shape of the internal wall of the feeder funnel. If the opening facing the internal space is disposed at a cylindrical internal wall section of the housing support, the respective section of the inner side of the bung is designed correspondingly partially cylindrical. The uniform, smooth design of the internal wall of the housing support is relevant in so far as profile discontinuities at the internal wall shall be excluded in order to minimise friction of the packaging material inside the housing support and thereby avoid a packaging material jam. In this way transport speeds of the packaging material through the packaging means of up to 100 m/min can be achieved.

The access passage represents a short access connection from the outside of the housing of the packaging means towards the tunnel-shaped internal space delimited by the internal wall structure of the housing support, through which the packaging material is transported. The bung represents a continuation in shape of the outside of the housing of the packaging means as well as of the inner wall face of the tunnel-shaped internal wall structure of the housing support.

In a further development of the invention the bung has a side facing away from the internal wall, which side comprises a handle for pulling the bung out of the access passage and is adapted in particular to the shape of the outside of the means. The bung is in the predetermined closed position when its internal side shuts off the opening of the access passage towards the internal space in a form-continuing manner. Upon adopting the predetermined closed position the latching mechanism shall provide a haptic latching signal to a person operating the bung so that the operating person recognises that the correct end position of the bung is reached. The latching mechanism may have an abutment function designed to avoid insertion of the bung beyond the opening of the access passage towards the internal space.

In a preferred embodiment of the invention a device is provided for deactivating a motor driving the forming wheel, wherein the device is then activated in order to deactivate the motor drive when the bung is not in a predetermined closed position for closing the access passage. Preferably a power supply is cut towards the motor drive upon activation of the device to ensure that the forming wheels cannot be driven even for a correspondingly operated speed controller.

In a further development of the invention the deactivation device can consist of a contact switch that, for an activated state, is switched such that a power supply to the motor drive is cut, wherein in the passive state the contact switch adopts a switch position in which power supply to the motor drive is possible.

Alternatively the deactivation device can present an electric line disposed at the bung that connects as an electric bridge two otherwise insulated connections in the area of the access passage then when the bung is in its predetermined closed position within the access passage.

The motor drive deactivation device according to the invention ensures that in the open state of the access passage an operating person can readily act manually on the forming wheels without encountering the danger that the forming wheels are driven by the motor. In this way, danger of injury is excluded then when the operating person intends to remove a packaging material jam at the forming wheel via the access passage.

The packaging means according to the invention enables to transport the packaging material web through the packaging means with a speed of up to 100 m/min.

Figure 2:
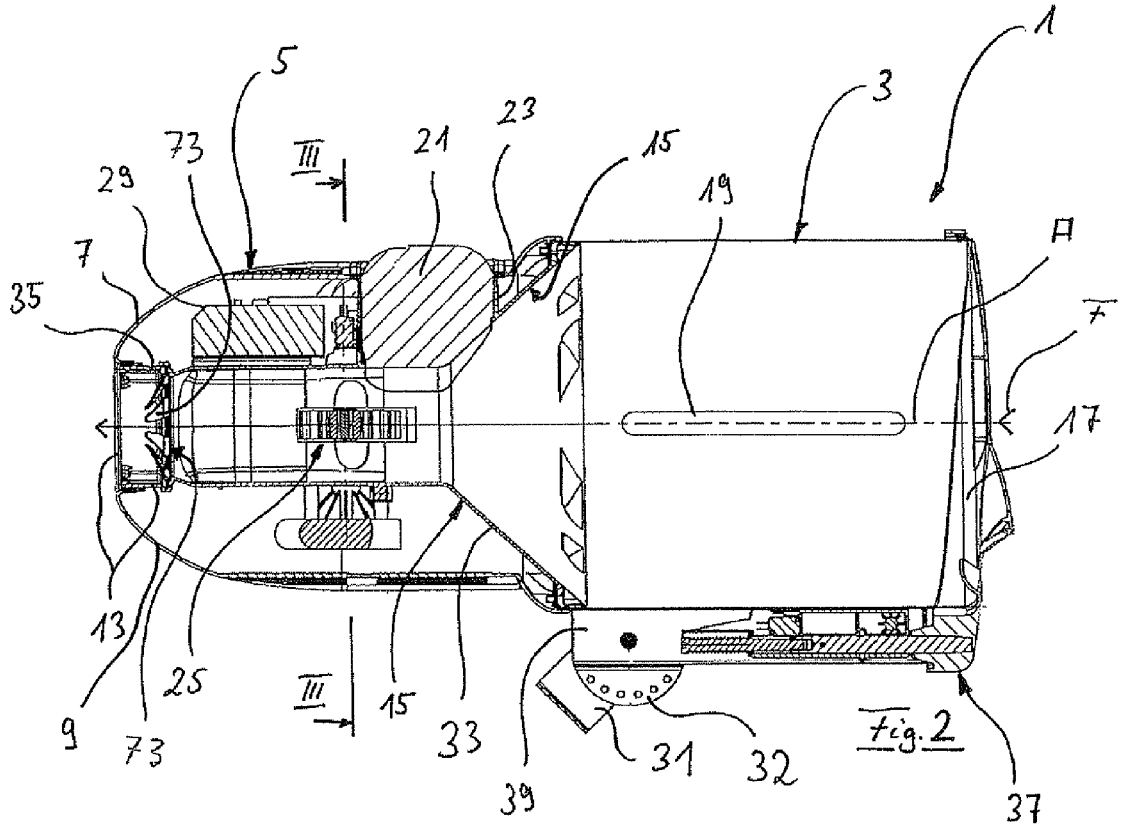
Figure 3:
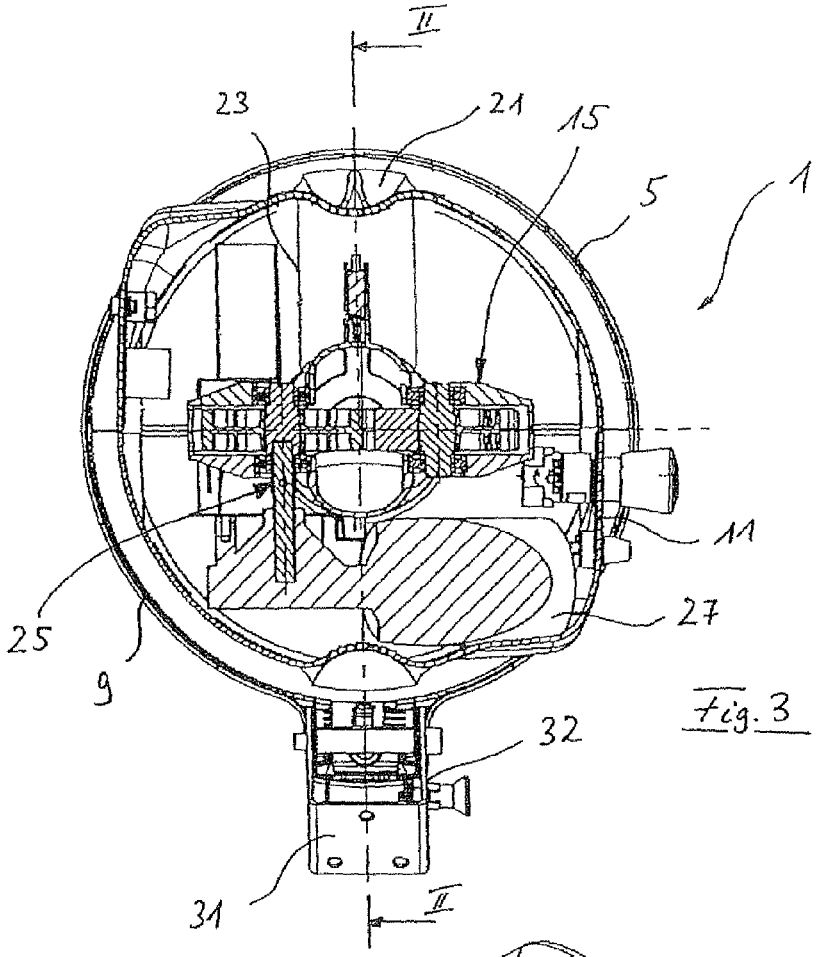
Figure 4:
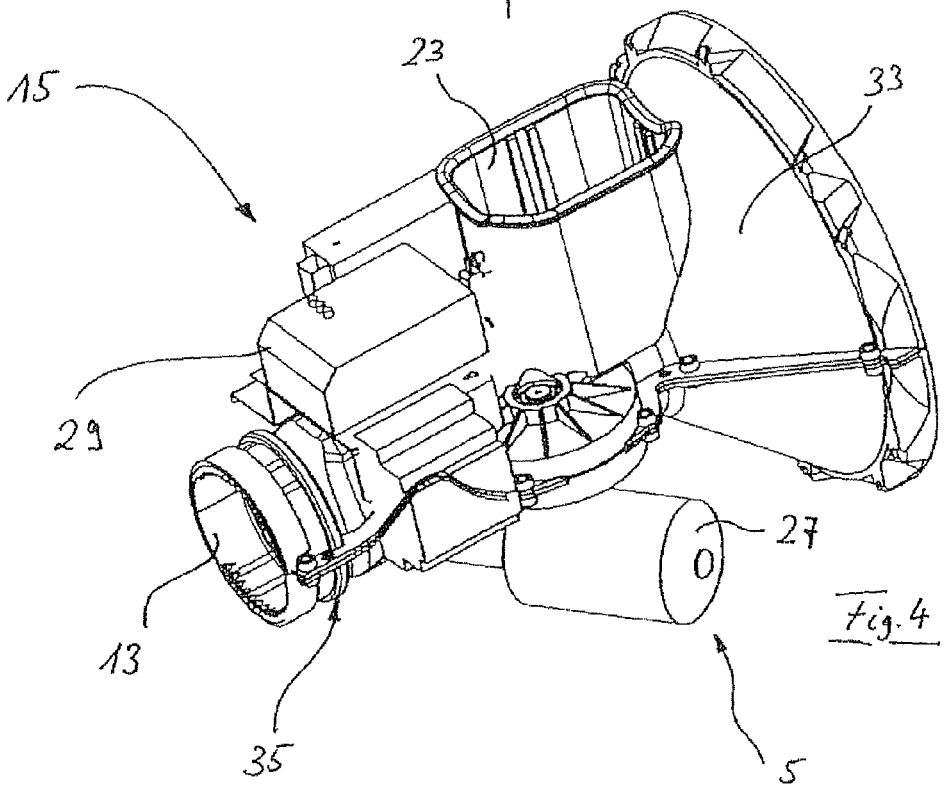
Figure 7:
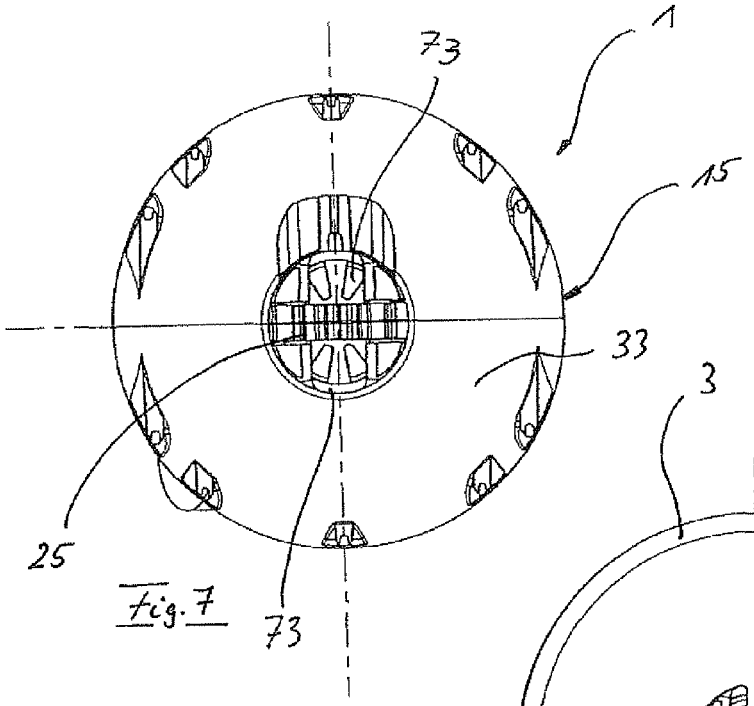
Figure 6:
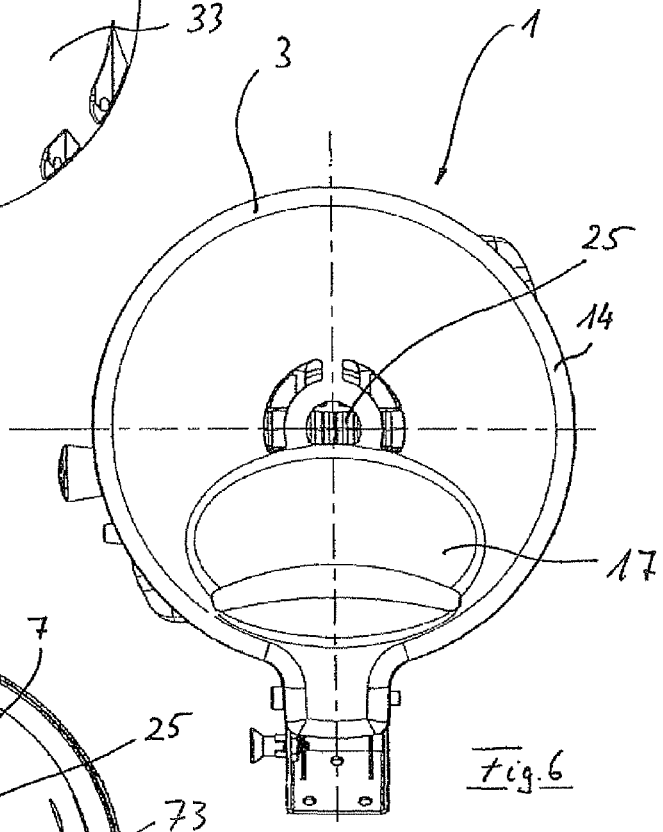
Figure 5:
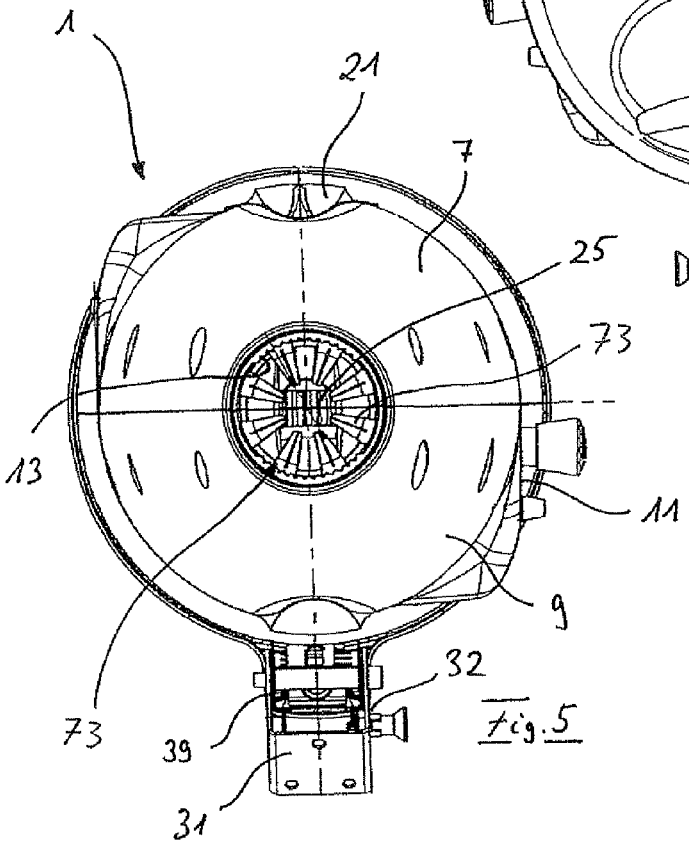
Figure 8:
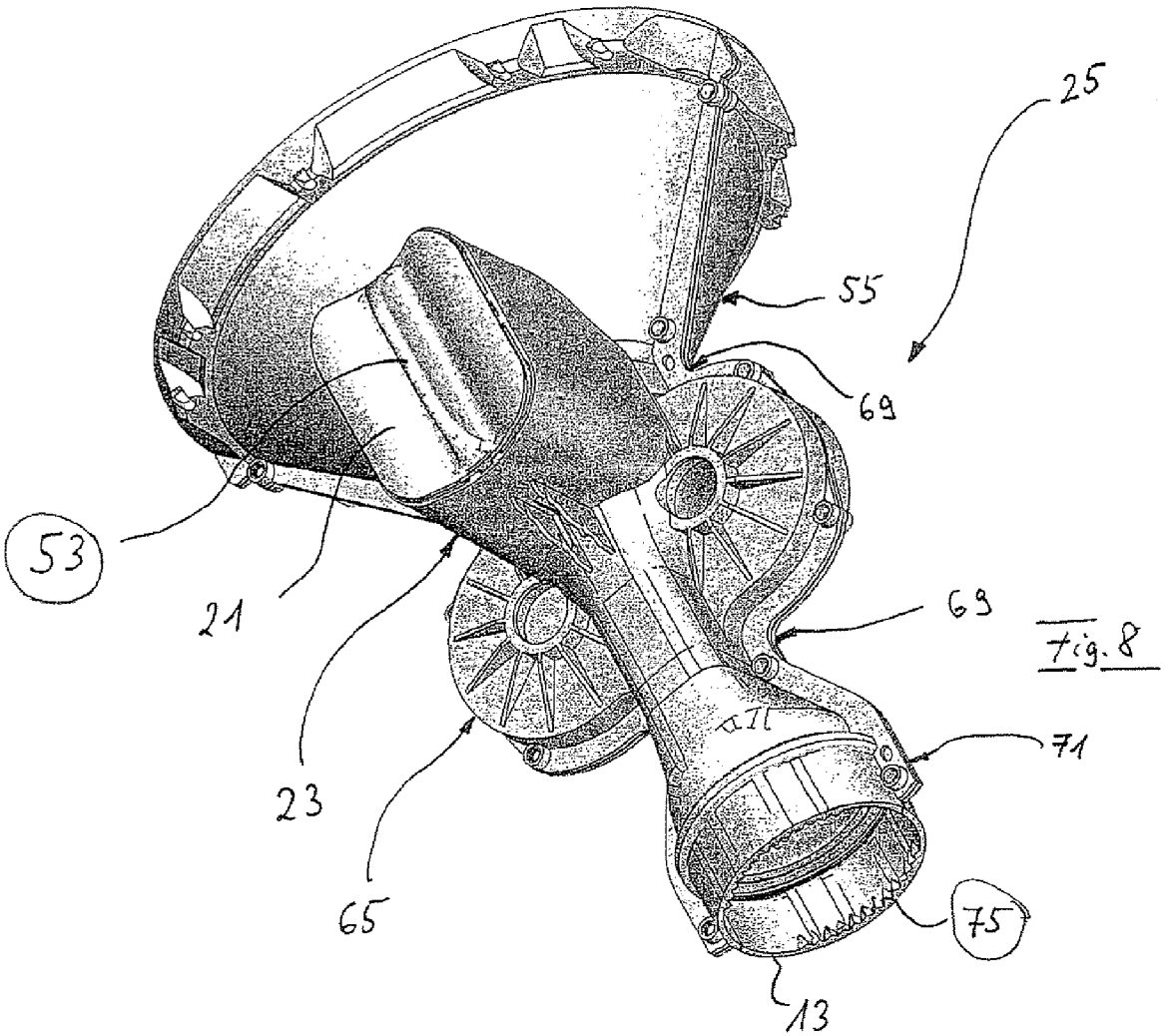
Figure 9:
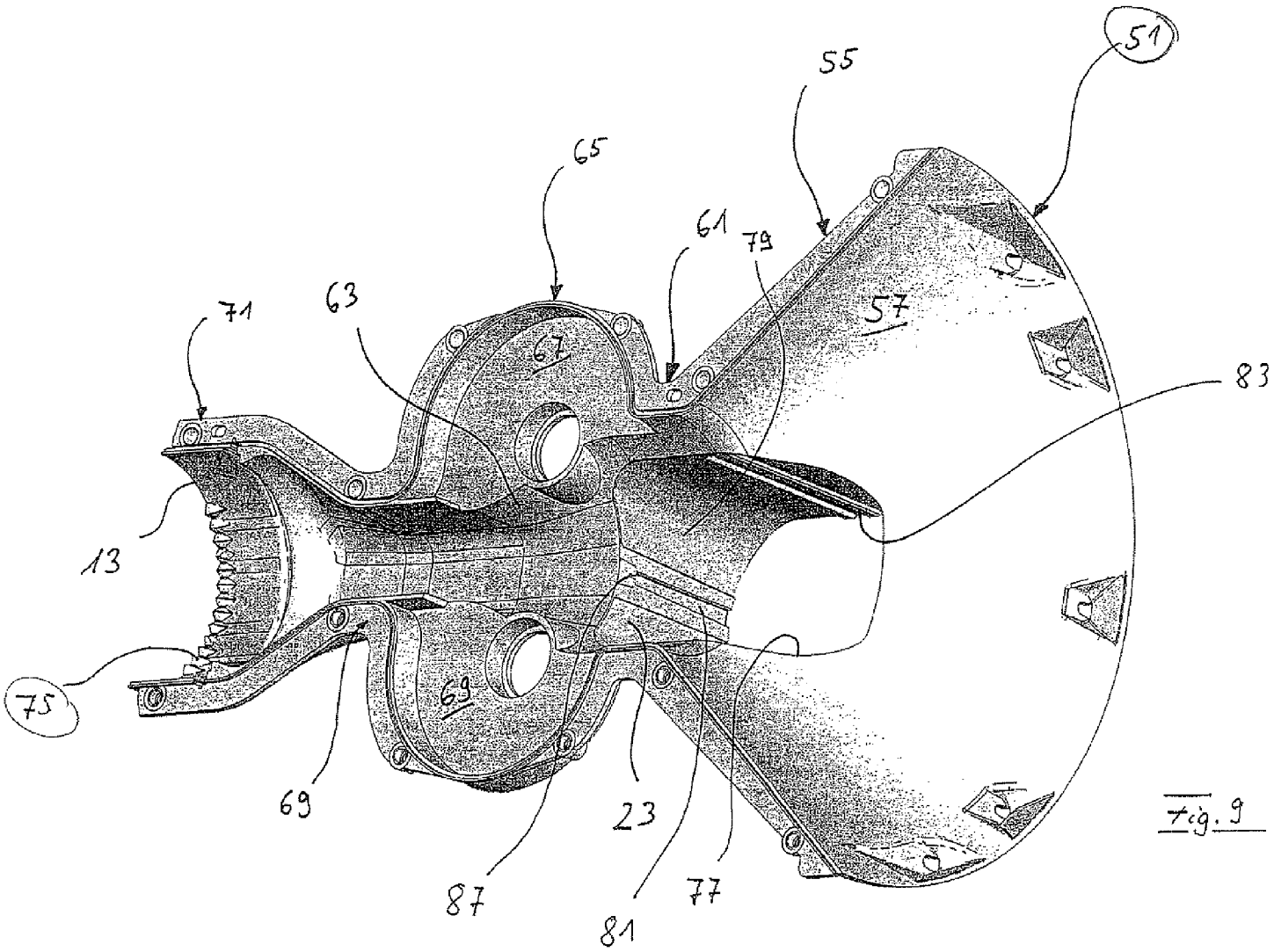
Figure 10:
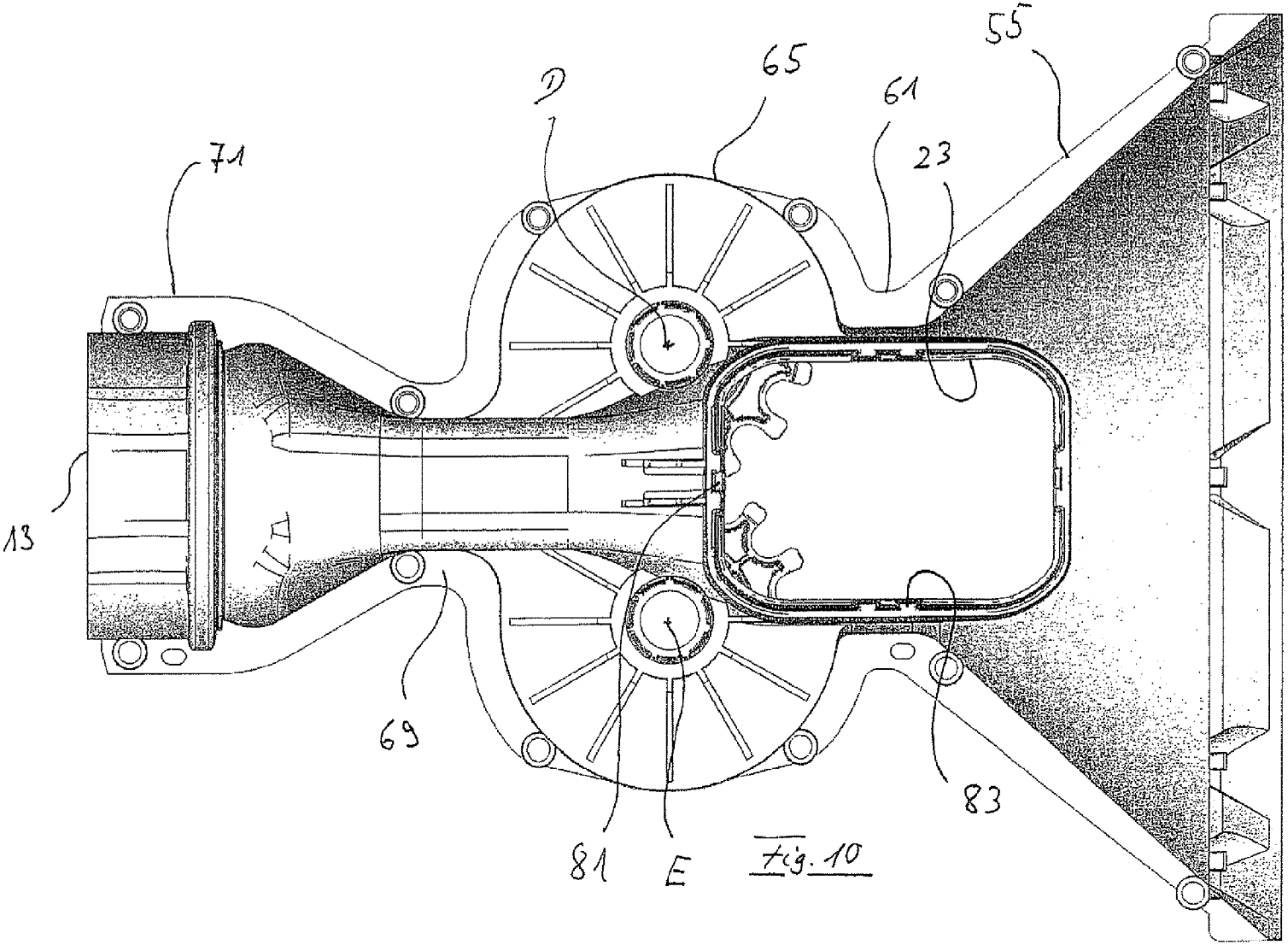
Figure 11:
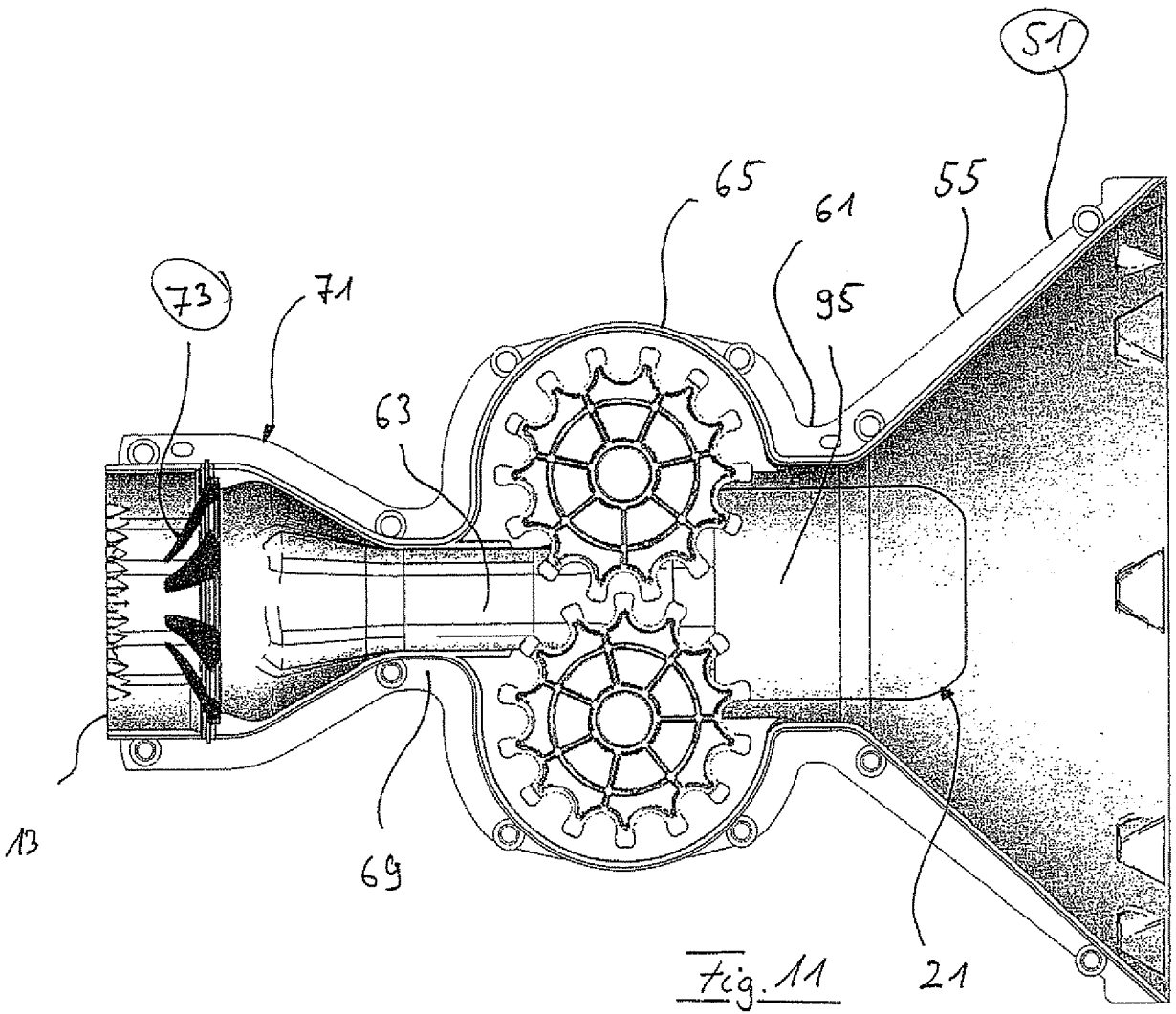
Figure 12:
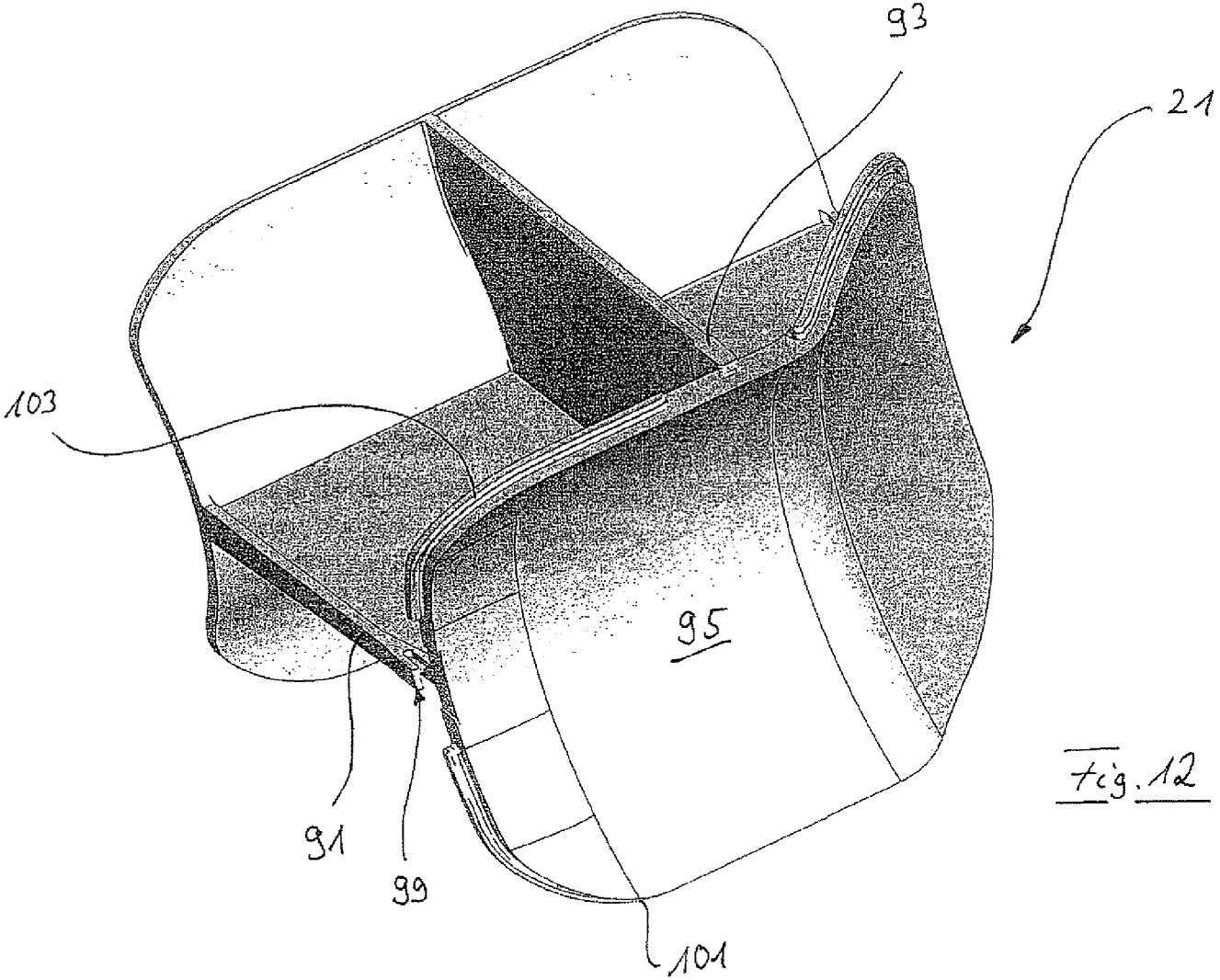
Figure 13:
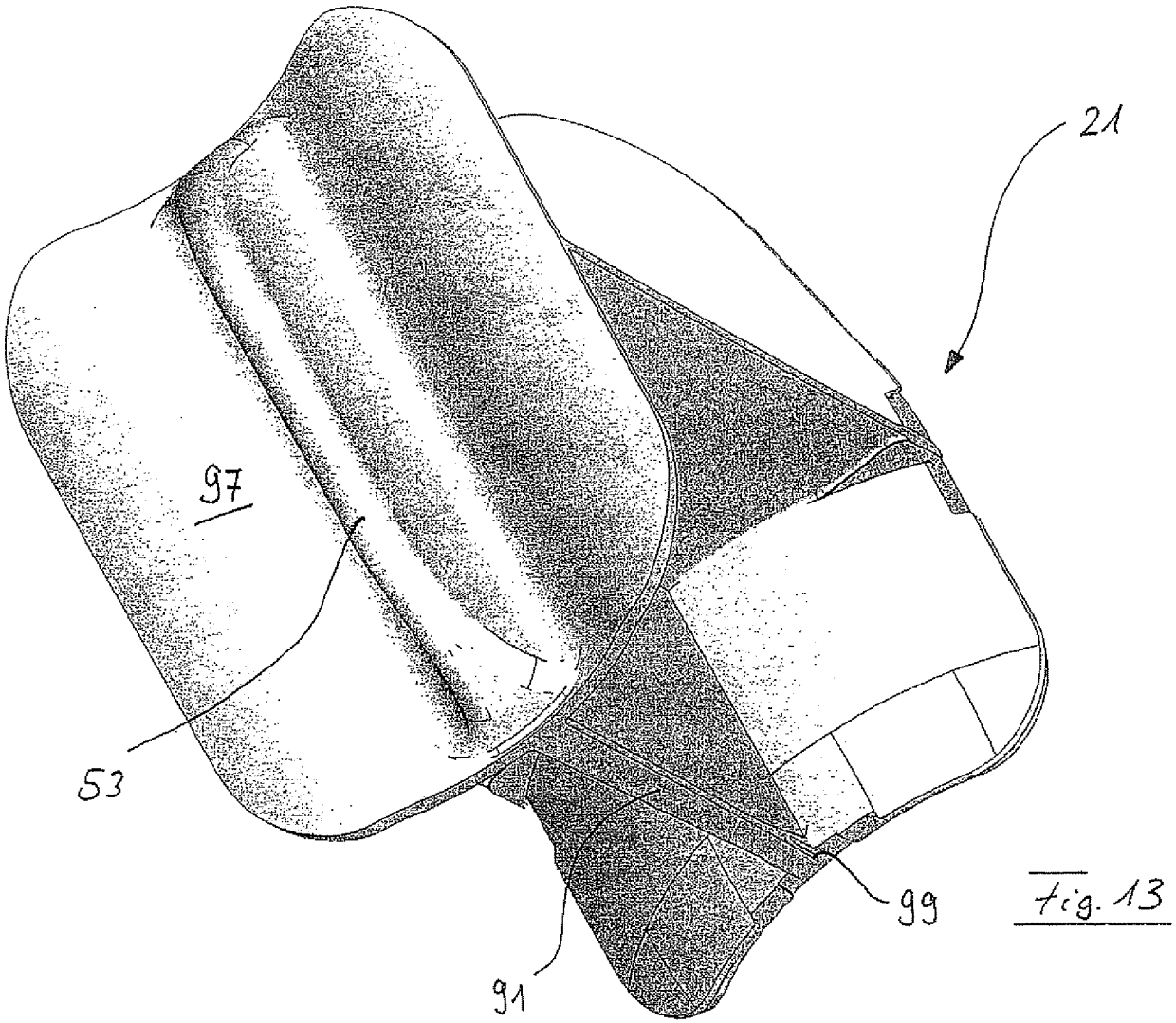

Further characteristics, advantages and features of the invention become apparent in the following description of a preferred embodiment of the invention in conjunction with the accompanying drawings showing:

FIG. 1 a perspective view of a means for providing packaging material according to the invention;

FIG. 2 a cross sectional view of the means for providing packaging material according to FIG. 1 along the section line II-II according to FIG. 3;

FIG. 3 a cross sectional view of the means for providing packaging material along the section lines III-III according to FIG. 2;

FIG. 4 a perspective view of the means for providing packaging material according to FIGS. 1 to 3 without decorative housing shells;

FIG. 5 a frontal view of the output side of the means for providing packaging material according to the FIGS. 1 to 4;

FIG. 6 a frontal view of the packaging material input side of the means for providing packaging material according to FIGS. 1 to 5;

FIG. 7 a frontal view of the packaging material input side of the device for providing packaging material according to FIGS. 1 to 6 without packaging material receiving organ;

FIG. 8 an enlarged perspective view of the housing support according to the invention with a closure bung disposed in the access passage;

FIG. 9 a perspective view of an upper housing shell forming the access passage of the housing support without closure bung;

FIG. 10 an exterior side view of the housing half shell according to FIG. 9 in longitudinal direction of the access passage with forming wheels being mounted;

FIG. 11 an internal side view of the housing half shell according to FIG. 10 with closed access passage;

FIG. 12 a perspective view from the inside of the access passage of a closure bung for closing the access passage; and FIG. 13 a perspective view of the closure bung according to FIG. 12 from its outside.

In FIGS. 1 to 7 the means for providing packaging material according to the invention is generally given the reference numeral 1. In the following, the means is referred to as packaging means 1.

The packaging means 1 comprises as main components a packaging material receiving organ 3 and a reshaping section 5 attached thereto covered by two outer housing shells 7, 9. A control panel 11 with respective operating controls and knobs is provided at the outside of the reshaping section 5.

An output opening 13 is delimited among others by recesses in the front side of the outer housing shells 7, 9.

The packaging material receiving organ 3 consists of a metal cylinder 14 connected by a form fit with a housing support 15 of the reshaping section 5 disposed inside the outer housing shells 7, 9 and closed by a closure cap 17 at its side facing away from the output opening 13. A viewing slot 19 extends in the metal cylinder 14 in axial direction A corresponding essentially to the transport direction F. The viewing slot 19 shall indicate to an operating person by how much the packaging material disposed inside the packaging material receiving organ 3 is already used like a paper web being reeled off the inside of a paper reel.

A mechanism 37 for opening the closure cap 17 is stowed in a compartment 39 separate from the metal cylinder 14 at its lower side. The opening mechanism 37 allows pivoting of the closure cap 17, wherein the pivoting axis S is disposed parallel to the axial direction A of the packaging means 1 and associated with the transport direction F. In addition, the mechanism 37 has a safety device preventing driving the motorised reshaping device 25 in case that the closure cap 17 is not located in the closure position on the metal cylinder 14 as shown in FIGS. 1 and 2.

At the reshaping section 5, a closure bung 21 inserted in an access passage 23 formed into the housing support 15 is operable from the outside for its removable. Via the access passage, a manual access onto the motor driven reshaping device 25 is easily possible. The reshaping section 25 is meant to deform the packaging material for creation of a certain filler material. To this end, the reshaping device has a pair of rotatably mounted toothed forming wheels each of which defining an axis of rotation D, E.

The toothed forming wheel is driven by an electric motor 27 of the reshaping device 21 held on a side of the housing support 15 opposite the access passage 23. A control circuitry 29 is attached to the housing support 15 within the housing shells 7, 9.

At its lower side, the packaging means 1 comprises a support flange 31 that is fixed to the packaging material receiving organ 3 and via which the packaging means 1 can be attached to a vertical supporting column not shown in detail. By means of an adjustment mechanism 32 that can be designed as an arrangement of a bolt and a group of holes the packaging means 1 can be brought into different pivoting positions relative to the stationary vertical support column and to the horizontal direction in order to facilitate for an operating person directing the packaging material onto a desired location.

For the operation, firstly the packaging material receiving organ is loaded with a reel of rolled-up material web (not represented). The material web reel is reeled off from its inside as in the generic packaging means of above-cited DE 10 2005 053 319 A1. The inside end of the material web reel is led to a feeder funnel 33 of the housing support 15 via the packaging material receiving organ 3. Transport of the packaging material towards the reshaping device 25 is defined by the cone-shaped internal wall of the feeder funnel 33, and the packaging material is fed towards the toothed forming wheel of the reshaping device 25. The motor driven toothed forming wheels seize the packaging material and deform it such that the desired filler material is formed. The filler material reaches the dispenser orifice 35 of the housing support 15 which defines the output opening 13 of the housing support 15.

The velocity with which the formed filler material leaves the output opening can be adjusted by the operating person via the operating panel 11 connected to the control circuitry 29.

In the output opening 13, a protective cap 73 is inserted via a bayonet joint or inserted in a snapping manner into a groove of the internal wall of the output opening or screwed onto the internal wall.

Downstream of the inserting position of the protective cap 73 a group of teeth 75 is provided at sections of the circumference in order to facilitate tearing off the reshaped packaging material.

In the following, the housing support 15 according to the invention is described in detail because the measure of forming the access passage 23 is realised at the housing support 15. As it can be seen in FIGS. 8 to 13 among other things, the upper half shell of the housing of the housing support 15 forming the access passage 23 is a plastic part, injection moulded in one piece, which reduces significantly the manufacturing costs for the housing support 15 according to the invention.

The access passage 23 is essentially radially centred and extends perpendicular to the transport direction axis and towards the transport path and is disposed parallel to the axes of rotation D, E of the toothed forming wheels of the reshaping device 25. If the packaging means 1 is oriented such that its internal transport path is horizontal, then the access passage 23 extends to the transport path in vertical direction.

In FIG. 8 it can be seen that the access passage 23 is closed by the closure bung 21, wherein at the outside a gripping protrusion 53 is provided at which an operating person can seize the closure bung 21 that is complementary in shape at the inside and at the outside.

The upper half shell 51 of the housing comprises a feeder funnel 55 having a cone-shaped internal wall 57 and being directed towards the packaging material reservoir. The access passage 23 leads up to an internal space of the housing support 15 for example in the area of the feeder funnel 55. A transition 61 is connected to the feeder funnel 55 the transition presenting a cylindrical internal wall, starting from which the internal wall is narrowing in transport direction. The narrowed section of the internal wall is to be associated with a mounting structure 65 presenting two recesses 67, 69 for receiving the toothed forming wheels of the reshaping device, as shown in FIG. 11.

Continuing from the mounting structure 65, a transition 61 connects to the latter having a rectangular internal wall with rounded corners from which a circular cylindrical dispenser orifice 71 develops, at which a protective cap 73 is disposed in order to prevent manual access into the internal space of the housing support 15.

At the output opening 13 of the housing support 15 teeth-like protrusions 75 are provided facilitating tearing off the packaging material at the output opening 13.

As evident from FIGS. 9 and 11, the access passage 23 extends to the transition 61 and partially into the mounting structure 65 and thus also its opening 77 towards the internal space is disposed in the transition 61 and partially in the mounting structure 65.

The access passage 23 has a constant rectangular cross section in its longitudinal direction, as evident from FIG. 10, the corners having large roundings.

An internal wall 79 of the access passage 23 has a uniform tubular internal profile, wherein a straight guiding groove 81, 83 is provided at each lateral and longitudinal side of the internal wall 79, which grooves enable a secure guiding of the closure bung 21 inside the access passage 23. The guiding grooves 81, 83 can be designed different from each other in such a way that merely one single position of the closure bung 21 is permitted inside the access passage 23, so that a misorientation of the closure bung 21 cannot occur during its fitting.

A contact switch 87 can be provided inside the guiding groove 81 at the end section towards the internal space, the switch being activated as soon as the closure bung 21 is inserted into the predetermined closure position shown in FIGS. 8 and 11.

The guiding grooves 81, 83 cooperate with respectively straight longitudinal protrusions 91, 93 at the closure bung 21, the protrusions being received in the respective guiding grooves 81, 83.

As shown in particular in FIGS. 12 and 13, the longitudinal protrusions 91, 93 slightly broaden from an inside 95 of the closure bung 21 towards its outside 97 in order to provide a stable closure position of the closure bung 21.

Furthermore, a latching mechanism 99 can be provided at the longitudinal protrusion 91, 93, the latching mechanism transmitting a haptic latching signal to a person operating the closure bung 21 as soon as the closure bung 21 is disposed in the correct closure position and the latching mechanism 99 is actuated.

A correct closure position is present then when the inner side 95 is inserted into the access passage 23 to form a continuous stepless internal wall shape of the housing support 15 as shown in FIG. 11. The inner side 95 of the closure bung 21 has a partially cylindrical section for closing the opening 77 of the access passage 23 towards the internal space in the area of the transition 61, as well as a partially cone-shaped section for closing the area of the opening 77 facing the internal space in the area of the feeder funnel and of the mounting structure, respectively.

As shown in FIG. 12, the outer rim 101 of the internal side 95 of the closure bung 21 is provided with a step shape 103 that cooperates abuttingly with a complementarily shaped step in the area of the access passage 23 so that the closure bung 21 cannot be inserted into the internal space of the housing support 15 beyond the correct closure position.

As recognisable in FIGS. 10 and 11, owing to the access passage 23, an operating person can readily access both toothed forming wheels of the reshaping device 25, in particular also the transport path area upstream of a reshaping zone formed by the engagement of the toothed forming wheels. A packaging material jam that, based on investigations by the applicant, can particularly occur upstream of the reshaping zone, can be remedied easily owing to the possibility of access through the access passage 23.

In order to minimise the danger of injury to an operating person in that in the open state of the access passage 23 the toothed forming wheels can under no circumstances be operated, it is ensured that an electric power supply to the electric motor driving the toothed forming wheels is cut if the closure bung 21 is not in the closure position shown in FIG. 11.

The features disclosed in the above description, the figures and the claims may be relevant for the realisation of the invention in its different embodiments individually as well as in any combination.

The invention claimed is:

1. An apparatus providing packaging material, comprising: a reshaping device including a pair of motor driven forming wheels, a housing support having a tunnel-shaped internal space, an input opening via which packaging material can enter the internal space, an output opening via which packaging material can leave the internal space in which the fuming wheels are disposed, wherein the forming wheels are rotatably mounted at the housing support and respectively define an axis of rotation, said housing support further including an uninterrupted access passage being open towards the internal space and open towards an outside of the housing support, the longitudinal direction of the access passage being essentially parallel to said rotational axes of the forming wheels and extending from the internal space to the outside of the housing support.

2. An apparatus as in claim 1, in which said forming wheels define a reshaping zone at which the forming wheels deform and drive the packaging material, wherein said reshaping zone is disposed inside the internal space of the housing support.

3. An apparatus as in claim 1, in which both said forming wheels are disposed in a common plane to which a longitudinal extension of the access passage is perpendicular.

4. An apparatus as in claim 1, in which said access passage is arranged with respect to the forming wheels in such a way that for a visual projection of the smallest clear width of the access passage in its longitudinal direction onto a common plane of the two forming wheels, sections of the forming wheels facing each other upstream of the reshaping zone, are, in equal proportions, inside of boundaries of the projection.

5. An apparatus as in claim 1, in which said housing support is held by a vertical support column pivotable around a horizontal pivoting axis.

6. An apparatus as in claim 1, in which a straight transport path is defined between the input opening and the output opening through said housing support and that, for horizontal positioning of said housing support, the transport path and the forming wheels are disposed in a common, horizontal plane.

7. An apparatus as in claim 1, in which a distance between the one forming wheel and the outside of the housing support through the access passage is essentially equal to a distance between the other forming wheel and the outside of the housing support through the access passage.

8. An apparatus as in claim 1, in which said access passage is dimensioned such that manual access to both forming wheels by an operating person is possible through the access passage.

9. An apparatus as in claim 1, in which said access passage presents an opening towards the outside that is generally rectangular in cross section, wherein the corners of the opening are rounded.

10. An apparatus as in claim 1, in which said access passage presents an opening towards the internal space, said opening being generally rectangular in cross section and having rounded corners, wherein the opening towards the outside is aligned with the opening towards the internal space.

11. An apparatus as in claim 1, in which a clear width of the access passage is uniform in its longitudinal direction.

12. An apparatus as in claim 1, in which said access passage is delimited by an internal wall that corresponds to an internal wall of a uniform tube profile.

13. An apparatus as in claim 1, in which said access passage is closed by a stopper, an inner side of which, facing the internal space, forms an uninterrupted continuation of the internal profile of the adjacent inner wall area of an internal wall structure delimiting the internal space.

14. An apparatus as in claim 13, in which said stopper presents a side facing away from the internal wall, which side comprises a handle for pulling the stopper out of the access passage and is adapted in particular to the outer profile of the outside of said housing support.

15. An apparatus as in claim 13, including a mechanism latching the stopper into a predetermined closed position for closing the access passage, the mechanism providing a latching signal to a person operating the stopper upon adopting the predetermined closed position.

16. An apparatus as in claim 15, including means for deactivating a motor drive driving the forming wheel, wherein said means is activated in order to deactivate the motor drive when the stopper is not in a predetermined closed position for closing the access passage.

17. An apparatus as in claim 16, in which electrical power to said motor drive is interrupted when said means for deactivating is activated.

18. An apparatus as in claim 17, in which said means for deactivating comprises a contact switch.

19. An apparatus as in claim 16, comprising an electric line disposed at the stopper that provides an electrical interconnection between two terminals when the stopper is in its predetermined closed position within the access passage.

* * * * *